United States Patent [19]

Newham et al.

[11] Patent Number: 5,017,937

[45] Date of Patent: May 21, 1991

[54] WIDEBAND HORN ANTENNA

[75] Inventors: Paul Newham, Stanmore; Bernard J. Andrews, Garston, both of England

[73] Assignee: The Marconi Company Limited, England

[21] Appl. No.: 475,032

[22] Filed: Feb. 5, 1990

Related U.S. Application Data

[63] Continuation of Ser. No. 156,281, filed as PCT GB87/00200 on Mar. 23, 1987, abandoned.

[30] Foreign Application Priority Data

Mar. 25, 1986 [GB] United Kingdom ..... 8607352

[51] Int. Cl.[5] ..... H01Q 13/00

[52] U.S. Cl. ..... 343/785; 343/786

[58] Field of Search ..... 343/785, 786, 772

[56] References Cited

U.S. PATENT DOCUMENTS

| | | | |
|---|---|---|---|
| 2,801,413 | 7/1957 | Beck | 343/785 |
| 3,305,870 | 2/1967 | Webb | 343/786 |
| 4,021,814 | 5/1977 | Kerr et al. | 343/786 |
| 4,468,672 | 8/1984 | Dragone | 343/783 |
| 4,673,947 | 6/1987 | Newham et al. | 343/785 |

FOREIGN PATENT DOCUMENTS

| | | | |
|---|---|---|---|
| 52-9349 | 1/1977 | Japan | 343/785 |
| 52-9350 | 1/1977 | Japan | 343/785 |
| 53-30143 | 3/1977 | Japan | 343/785 |
| 53-146557 | 12/1978 | Japan | 343/785 |

OTHER PUBLICATIONS

Johnson et al, "Ridge Loaded Horns", Antenna Engineering Handbook, 1984, pp. 40-3-40-4.

*Primary Examiner*—Michael C. Wimer
*Assistant Examiner*—Hoanganh Le
*Attorney, Agent, or Firm*—Kirschstein, Ottinger, Israel & Schiffmiller

[57] ABSTRACT

A wideband hybrid horn antenna in which a circular section horn (1) is fed by a circular feed guide (3). A dielectric polyrod (7) is cantilever mounted in the throat end (4) of the horn (1) and is tapered to provide a match to the guide (3). Its forward section is tapered from the guide diameter down to about 2 mm just outside the mouth (11) of the horn (1). The various dimensions—horn diameter at throat and aperture, flare angle, polyrod diameter taper and extent—are all chosen to produce a balance of opposing effects on the beamwidth and thus provide a fixed beamwidth substantially independent of frequency over a wide band. A large bandwidth, from 8 to 16 GHz in the particular case, is thus obtained with a substantially constant beamwidth over the band.

4 Claims, 3 Drawing Sheets

ANTENNA GAIN FOR 30° HORN

45° PLANE, PEAK CROSS-POLAR LEVEL FOR 30° HORN

WIDEBAND HORN ANTENNA

This is a continuation of application Ser. No. 156,281, filed Feb. 16, 1988.

BACKGROUND OF THE INVENTION

This application is a continuation of international application No. PCT/GB87/00200, filed Mar. 23, 1987, which, in turn, claimed the priority of United Kingdom application Ser. No. 8607352, filed Mar. 25, 1986.

1. Field of the Invention

This invention relates to wideband horn antennas.

2. Description of Related Art

One conventional hybrid mode horn consists of a circular horn with a series of internal annular 'teeth' or ridges. Such a corrugated horn has limited bandwidth owing to the conditions under which the HE11 hybrid mode is formed.

Other horn antennas have been proposed, for example in German DPS 936400 and DOS 1591747, in which a dielectric rod is incorporated in a horn in an attempt to provide a suitable beam. It was not however, realised or even contemplated, in these proposals that only with a particular narrow set of design conditions can wideband operation be achieved to any satisfactory extent.

SUMMARY OF THE INVENTION

It is therefore an object of the present invention to provide a horn antenna of such design as to achieve wideband frequency operation.

According to the present invention, in a wideband horn antenna comprising a horn coupled directly to a waveguide feed and including a dielectric rod extending axially from the throat of the horn to the horn aperture, the dielectric rod being tapered towards the aperture, the dimensions of the horn and the dielectric rod are such that the beam broadening effect resulting from the changing aperture field with frequency is balanced by the basic beam narrowing effect of increasing frequency associated with a finite aperture.

The horn is preferably of circular section having a flare angle of approximately 60°. The horn preferably has a throat diameter of approximately 16 millimeters and an aperture diameter lying substantially in the range 60 millimeters to 140 millimeters. The dielectric rod may have a relative dielectric constant lying substantially in the range 2.1 to 2.5.

The dielectric rod preferably has a diameter at the aperture in the range 5 millimeters to 7 millimeters according to the dielectric constant and extends a short distance beyond the horn aperture. The dielectric rod may be of PTFE.

The waveguide feed is preferably circular having a quad-ridge internal formation comprising four longitudinal metal portions regularly disposed around the circumference and extending from the internal surface of the waveguide toward the axis.

BRIEF DESCRIPTION OF THE DRAWINGS

A wideband horn antenna in accordance with the present invention will now be described, by way of example, with reference to the accompanying drawings, of which.

DETAILED DESCRIPTION OF THE PREFERRED EMBODIMENTS

Figure 1:
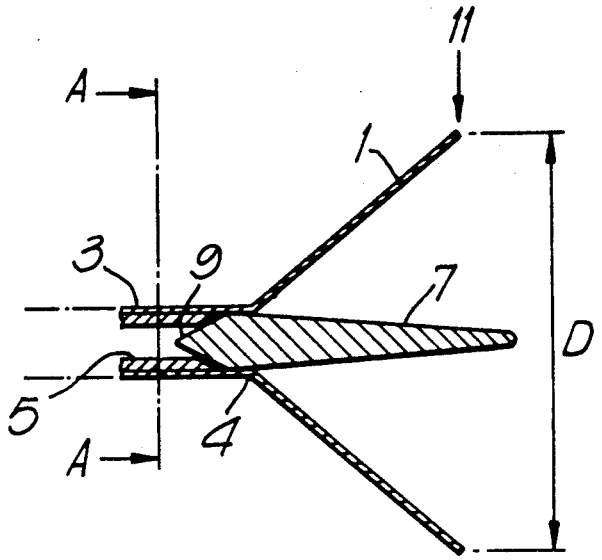
FIG. 1 is a sectional elevation of the antenna.
Figure 2:
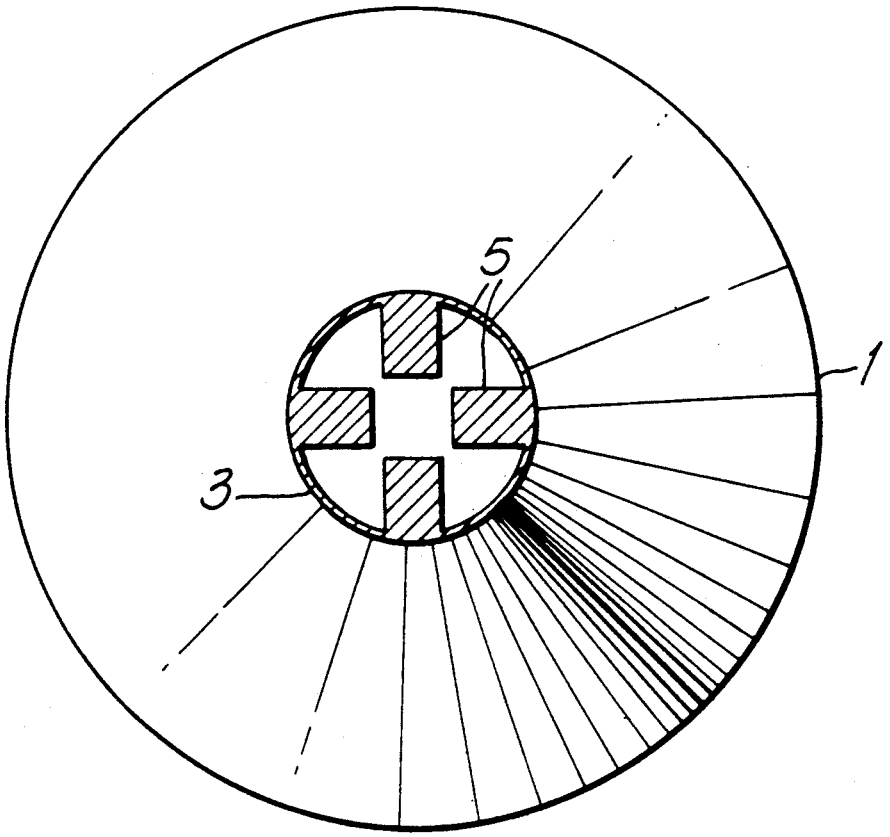
FIG. 2 is a cross sectional view to an enlarged scale on the line A—A of FIG. 1.

FIG. 1 shows a conical horn 1 having a semi-flare angle of 30°. While this is the preferred figure, a variation of 3 or 4 degrees either side of this will provide a satisfactory result. The total flare angle may thus lie between about 55° and 65°. The antenna is designed for an operating frequency in the range 8 to 16 gigahertz and the horn has a mouth or aperture diameter D of 80 millimeters in the particular example. A circular feed guide 3 is directly coupled to the throat 4 of the horn e.g. by integral manufacture or brazed assembly, the throat diameter being approximately 16 millimeters. This guide 3 has four metal ridges 5 extending longitudinally, and regularly disposed around the circumference in known manner. As shown in FIG. 2 the ridges extend inwardly toward the axis.

The diameter of the horn aperture, D in FIG. 1, determines the beam width. A value of 80 millimeters produces the beam width indicated in FIGS. 3 & 4 but a range of values between about 60 millimeters and 140 millimeters will result in useful beam widths. It will be clear that the aperture diameter is varied by varying the axial length of the horn, without variation of the flare angle. The beam width is a function of $\lambda/D$ and thus an increase in D at constant frequency produces a narrower beam width, other things being equal.

Mounted in the throat 4 of the horn is a circular section dielectric rod 7 which extends from the throat to a position just outside the aperture 11 of the horn, the rod 7 being made of PTFE (polytetrafluoroethylene) tapered uniformly throughout its length towards the aperture 11 of the horn where the rod diameter is 5 millimeters. The rod continues for a short distance to a terminating diameter of typically 2 millimeters.

The rear end of the rod 7 is tapered (9) within the feed guide 3 to provide a good electrical match into the guide, the leading ends of the ridges 5 being tapered in complementary manner.

Figure 3:
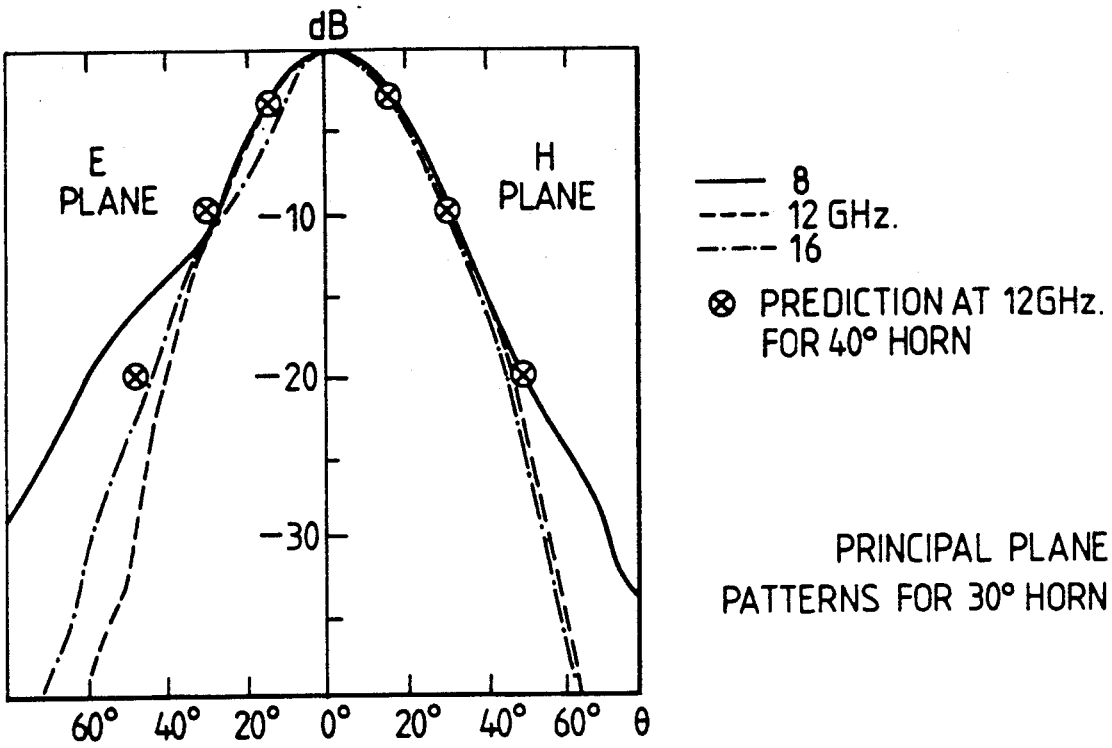
FIG. 3 is a gain characteristic showing the beam width in E & H planes for various operating frequencies.

FIG. 3 shows the E & H plane radiation patterns at 8, 12 & 16 GHz for the antenna, illustrating the substantially constant beamwidths with frequency.

Figure 4:
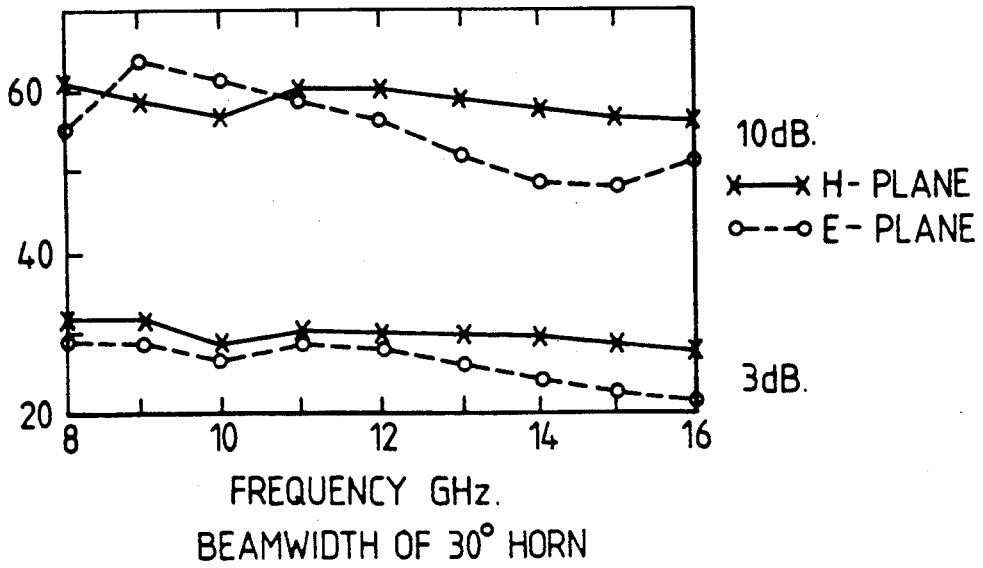
FIG. 4 is a graph of beam width for two spot gain values against frequency.

FIG. 4 shows the low value of frequency dependence of the E & H plane beamwidths, by way of two spot amplitude values, 3 db and 10 db.

Figure 5:
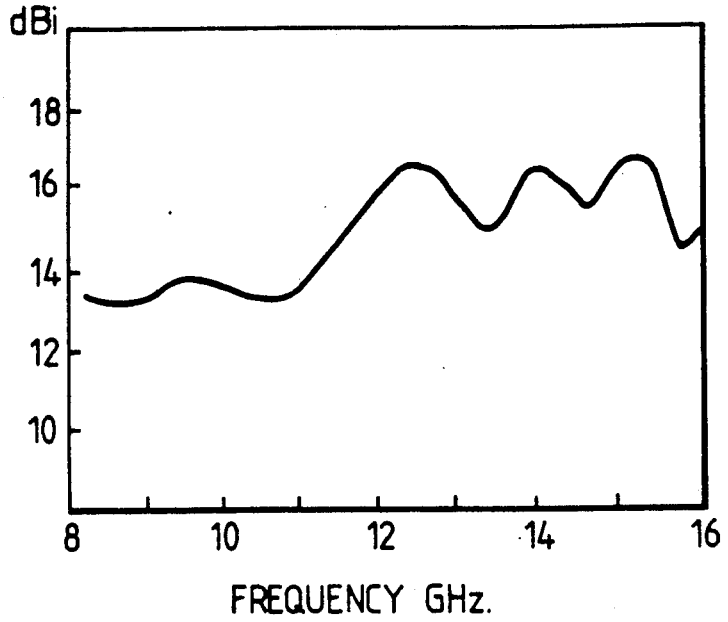
FIG. 5 is a graph of antenna gain against frequency.
Figure 6:
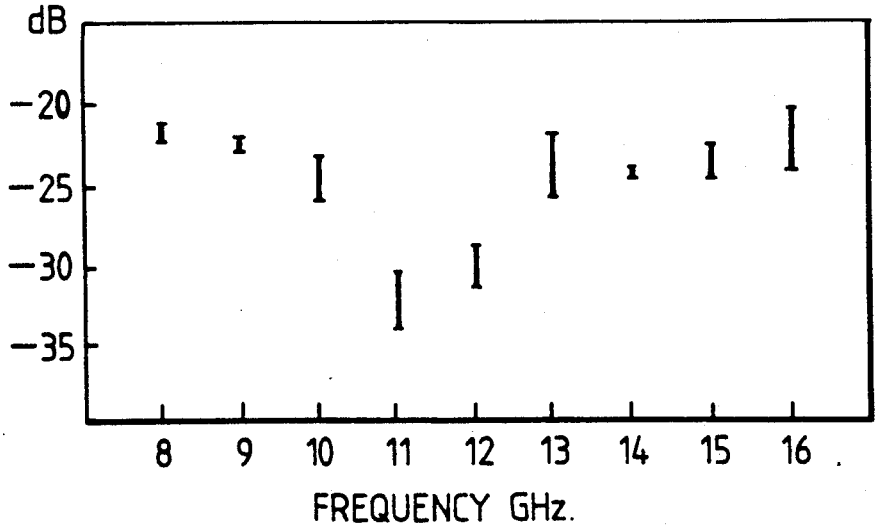
FIG. 6 is a graph of cross-polar coupling against frequency in a plane at 45° to both the E & H planes.

FIG. 5 shows the antenna gain as a function of frequency, the variation being less than 4 dBi (dB isotropic, i.e. relative to a standard reference). FIG. 6 shows the peak cross-polar levels in the 45 degree planes over the band.

The results are all indicative of a circular aperture illuminated by the He11 hybrid mode. The hybrid mode comprises two modes which would not propagate in unison in a standard guide, but are so constrained by the dielectric rod 7 within the horn.

The operation of the structure can be thought of as follows. The dielectric rod 7, or poly rod, naturally supports the He11 mode. Near the throat of the horn 1 the field is mainly confined within the dielectric and the horn wall has little effect on mode propagation. As the field propagates along the tapered polyrod, it becomes less tightly bound to the dielectric and fills the surrounding air. However, the horn walls are now receding from the dielectric and again provide only a small perturbation on the field. At the aperture of the horn the field resides almost wholly outside the dielectric and the aperture is then illuminated with the He11 field distribution. In effect, the constituent TE11 and the TM11 components of the He11 mode are forced to propagate along the horn with the same phase velocity by the presence of the dielectric.

The polyrod is a surface wave propagator and illuminates the horn aperture with a co-phased electromagnetic field, the strength of which decays radially outwards from the horn axis. The aperture field distribution decays more rapidly with increasing frequency and thus produces beam broadening. Under a narrow set of conditions, this beam broadening associated with the changing aperture field is exactly compensated by the beam narrowing with frequency due to the $\lambda/D$ term associated with a finite aperture. The result is a constant beamwidth with frequency. These conditions are as follows:

(1) a horn semi-flare angle close to 30°;
(2) a throat diameter of 16 mm;
(3) an aperture diameter between 60 mm and 140 mm;
(4) a polyrod with relative dielectric constant between 2.1 and 2.5;
(5) a polyrod linearly tapered from the horn throat to a terminating diameter of typically 2 mm just beyond the horn aperture, with a diameter at the aperture of between 5 mm at $\epsilon_r=2.1$ and 7 mm at $\epsilon_r=2.5$.

The mode of operation differs from that of a scalar corrugated horn (having a very wide flare angle) in that the latter is a phase dominated device, whereas the present invention is amplitude controlled. As such, the beamwidths should not correspond necessarily at the same flare angle; indeed, as shown in FIG. 3, the predicted beamwidth of a 40° semi-flare angle corrugated horn at the 3 dB, 10 dB and 20 dB levels show good agreement with the measured data.

It should be noted that where specific values and dimensions are quoted above these may be varied by a few percent, say ±5 percent unless other tolerances are indicated.

With its very wideband properties, this horn is particularly suited to electronic-support-measures (ESM) and jamming applications. With an appropriate polariser, the uniform beamwidth will result in good circular polarisation. The horn would also be suitable as a feed for a wideband reflector antenna. In particular, its low cost would make it an economic choice in a mass produced direct broadcast by satellite (DBS) receiving antenna.

We claim:

1. A wideband antenna providing a directional beam whose width is generally independent of frequency over a broad frequency range, the antenna comprising;

(a) a generally conical horn symmetrical about an axis, said horn including a throat having a diameter of approximately 16 millimeters, an aperture having a diameter lying substantially in the range 60 millimeters to 140 millimeters and a flare angle between said throat and said aperture of approximately 60°;
(b) a waveguide feed coupled directly to said throat; and
(c) a dielectric rod having a dielectric constant lying substantially in the range 2.1 to 2.5, said rod extending symmetrically about said axis from said waveguide feed to a point just beyond said aperture and being tapered toward said axis from said throat to said aperture so that at said aperture the rod has a diameter lying substantially in the range 5 millimeters to 7 millimeters.

2. A wideband antenna according to claim 1, wherein said dielectric rod comprises polytetrafluoroethylene.

3. A wideband antenna according to claim 1, wherein said waveguide feed is circular and has an internal surface, a longitudinal axis and a quad-ridged internal formation comprising four longitudinal metal portions regularly disposed around said internal surface, said longitudinal metal portions extending radially from said internal surface toward said longitudinal axis.

4. A wideband antenna according to claim 3, wherein each said longitudinal metal portion is tapered toward said internal surface in a direction toward said throat.

* * * * *